US008191480B2

(12) United States Patent
Mcaninch

(10) Patent No.: US 8,191,480 B2
(45) Date of Patent: Jun. 5, 2012

(54) METHOD AND APPARATUS FOR PROPELLING A PELLET OR BB USING A SHOCK-SENSITIVE EXPLOSIVE CAP

(75) Inventor: Chris Mcaninch, Grimes, IA (US)

(73) Assignee: GunsandMore.Info LLC, Grimes, IA (US)

( * ) Notice: Subject to any disclaimer, the term of this patent is extended or adjusted under 35 U.S.C. 154(b) by 684 days.

(21) Appl. No.: 11/702,350

(22) Filed: Feb. 5, 2007

(65) Prior Publication Data

US 2007/0181029 A1 Aug. 9, 2007

Related U.S. Application Data

(60) Provisional application No. 60/771,568, filed on Feb. 8, 2006.

(51) Int. Cl.
*F42B 5/02* (2006.01)
*F42B 8/00* (2006.01)
*F41A 19/00* (2006.01)

(52) U.S. Cl. ..... 102/447; 102/444; 102/431; 102/439; 102/502; 102/520

(58) Field of Classification Search ..... 102/431–433, 102/436, 438, 439, 441, 447, 448, 502, 520, 102/521, 522, 529
See application file for complete search history.

(56) References Cited

U.S. PATENT DOCUMENTS

| | | | | | |
|---|---|---|---|---|---|
| 2,654,318 | A * | 10/1953 | Dunham | 102/430 |
| 3,060,856 | A * | 10/1962 | Dunn | 102/447 |
| 3,245,349 | A * | 4/1966 | Kerr | 102/447 |
| 3,429,262 | A * | 2/1969 | Kincheloe et al. | 102/438 |
| 3,687,078 | A * | 8/1972 | Gadomski et al. | 102/453 |
| 3,728,966 | A * | 4/1973 | Woodring | 102/432 |
| 3,804,019 | A * | 4/1974 | Hurley | 102/448 |
| 4,080,899 | A * | 3/1978 | Luban | 102/458 |
| 4,361,093 | A * | 11/1982 | Saxby | 102/447 |
| 4,446,771 | A * | 5/1984 | Anthony et al. | 89/14.6 |
| 4,682,545 | A * | 7/1987 | Jett, Jr. | 102/430 |
| 4,735,009 | A | 4/1988 | Jett, Jr. | |
| 4,899,660 | A * | 2/1990 | Brighton | 102/447 |
| 5,035,183 | A * | 7/1991 | Luxton | 102/502 |
| 5,259,319 | A * | 11/1993 | Dravecky et al. | 102/447 |
| 6,895,865 | B2 * | 5/2005 | Bond | 102/520 |
| 7,316,092 | B2 * | 1/2008 | DeLeeuw | 42/51 |
| 2004/0134112 | A1 * | 7/2004 | Lizarralde et al. | 42/51 |
| 2007/0028499 | A1 * | 2/2007 | DeLeeuw | 42/51 |
| 2008/0098922 | A1 * | 5/2008 | Gleue | 102/447 |

FOREIGN PATENT DOCUMENTS

| | | | |
|---|---|---|---|
| EP | 49125 | A1 * | 4/1982 |
| WO | WO 9114916 | A1 * | 10/1991 |

* cited by examiner

*Primary Examiner* — Michael David
(74) *Attorney, Agent, or Firm* — Brett Trout

(57) ABSTRACT

A method and apparatus for expelling a projection from an air gun by striking a primer cap filled with a shock-sensitive explosive compound, causing the cap to explode, which in turn rapidly compresses a volume of air located between the projectile and the cap, causing the projectile to exit from the barrel of the air gun at a high rate of speed.

9 Claims, 5 Drawing Sheets

METHOD AND APPARATUS FOR PROPELLING A PELLET OR BB USING A SHOCK-SENSITIVE EXPLOSIVE CAP

Applicant claims the benefit of Provisional Patent Application No. 60/771,568 filed on Feb. 8, 2006.

BACKGROUND OF THE INVENTION

1. Field of the Invention

This invention relates to a method and apparatus of propelling a pellet or BB from a gun using a shock-sensitive explosive cap or primer. As conventional firearms come under political attacks, gun enthusiasts are being forced to look to other means of recreational shooting. More and more, these enthusiasts are turning to air actuated shooting rifles and handguns to hunt and to target practice.

2. Description of the Prior Art

One of the earliest known air guns was the Austrian 1780 model named "Windbiichse" which literally translates to "wind rifle" in German. This early design was developed by Bartholomeo Girandoni. The concept of an air gun has not changed to a large degree since this early design. An air gun generally operates by having compressed air rapidly released from an air tight chamber behind a projectile that then travels rapidly through a gun barrel. The means by which this compressed air is generated is the greatest distinguishing feature amongst the many different designs of air guns.

The reservoir gun, sometimes called "multi-pump" gun, has a pump to compress air into a reservoir. These pumps can be operated in a myriad of ways, but the most common is to have part of the gun stock serve as a pump lever. The lever is hinged at one end and the other end is allowed to swing away from the gun barrel. The compressed air is generated by forcing the lever into the closed position. The reservoir gun, or pump design, is still commonly used in the United States. The most common application of this technology is typically referred to as a "BB gun." This type of gun has been made famous by U.S. manufacturers Daisy and Crossman.

The greatest limitation about the "multi-pump" pneumatic gun is that it requires multiple compressions to generate enough compressed air to effective launch a projectile. Because of the typical design of the pump, there is a very real concern of pinching fingers between the pump lever and the gun barrel. Further, the pumping action requires a certain level of coordination and strength that may be troublesome to some users. Additionally, because it is a multiple pump design, it is problematic to generate consistent compressed air pressure in the chamber, and thus problematic to generate consistent projectile speed and trajectory.

Another air gun design is the spring-piston gun. This design typically is a single shot design that requires the breaking of the gun barrel at a hinged point to load a single projectile. After the projectile is loaded into the barrel, the barrel is then swung shut. While closing the gun barrel, a spring is compressed behind the projectile. When the trigger is pulled, the spring is released, and the air between the projectile and the plunger attached to the spring is compressed at a high rate of speed. This compressed air then forces the projectile through the gun barrel at a high rate of speed.

The problem with the spring-piston gun is that the spring is very strong or powerful. For the trigger to be effective, the spring is held back by a sear that has a very small engagement area. There is a very real danger that fingers can be pinched or even crushed if the sear was to unexpectedly release the spring.

Another method of compressing gas is to use pressurized air held in separate canisters or tanks. Typically, these canisters are filled with either carbon dioxide or compressed air. The canister then serves as a reservoir when attached to the air gun. A portion of the gas is ejected each time a projectile is fired out of the air gun.

The problem with this compressed gas system is that the pressure steadily decreases with each shot. $CO^2$ canisters are also temperature sensitive, in that lower temperatures cause reduced pressure, which reduces velocity. Compressed air tanks are less sensitive to temperature variations. This variance in pressure causes the flight path of each projectile to be different. The difference in flight effectively renders the canister style systems ineffective as hunting or target shooting tools. Additionally, the canisters are bulky and heavy, making the use of the air gun awkward when the canisters are attached. Further, there is an inherent danger when handling canisters of highly compressed gas.

It is very desirable to have an alternative to traditional firearms that can be used by firearm enthusiasts to recreationally target shoot and hunt that has a high degree of repeatable accuracy. Therefore, an easily assembled and accurate non-firearm rifle or hand gun utilizing a new method of propulsion is important.

FEATURES OF THE INVENTION

A general feature of the present invention is the provision of an improved method of propelling a projectile, such as a pellet or BB, along a gun barrel by use of an explosive percussion or primer cap.

A further feature of the present invention is the variance of projectile velocity by adjusting the gap between the cap and projectile in the chamber.

An additional feature of the present invention is the provision of a highly repeatable projectile velocity.

Yet another feature of the present invention is the provision of a method of loading an air gun that does not require a spring or pump.

A further feature of the present invention is the utilization of commonly available components to effectuate the method disclosed.

SUMMARY OF THE INVENTION

The present invention generally comprises a method of propelling a projectile from a gun barrel by a shock-sensitive explosive mixture cap and the projectile in an enclosed chamber. The method comprises inserting a projectile, typically a pellet or BB, into a gun barrel adjacent to one end of a compression chamber and placing a primer cap at the other end, with the explosive portion of the cap towards the projectile. The chamber is then closed, creating an essentially airtight chamber. The primer cap is then struck by a hammer, causing the shock-sensitive explosive mixture to rapidly expand and then rapidly eject the projectile along the gun barrel. The speed of which the projectile exits the gun barrel is determined by the length and diameter of the gap between primer cap and the projectile in the compression chamber, if any. The highest velocity is achieved when the pellet or BB engages the primer cap.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1A:
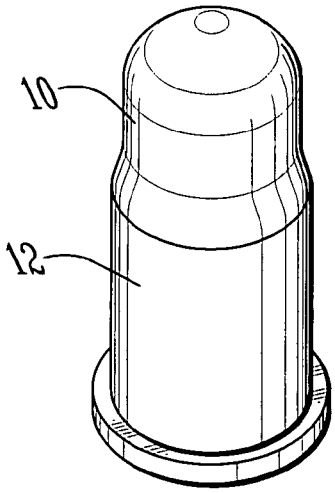
FIG. 1A is a front perspective view of the invention wherein the pellet and primer are depicted in relationship to one another.

The present invention will be described as it applies to its preferred embodiment. It is not intended that the present invention be limited to the described embodiment. It is intended that the invention cover all modifications and alternatives, which may be included within the spirit and scope of the invention. In a preferred embodiment, the method of projecting a projectile along a gun barrel is achieved through the actuation of a primer cap the rear end of the barrel to force the projectile to exit the opposite end of the gun barrel at a specified rate of speed.

Referring to the drawings.

Figure 1B:
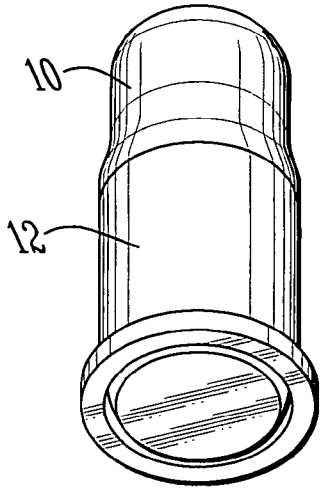
FIG. 1B is a rear perspective view of the invention wherein the pellet and primer are depicted in relationship to one another.
Figure 1C:
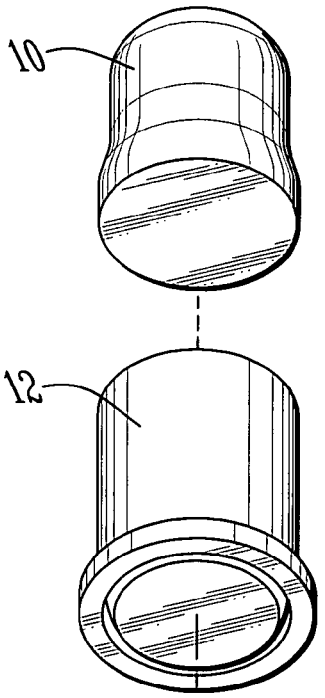
FIG. 1C is an exploded view of the primer and pellet according to the present invention.
Figure 1D:
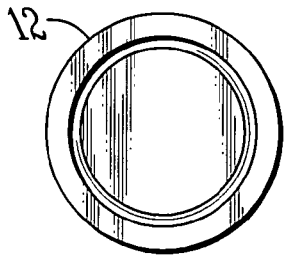
FIG. 1D is a rear elevation view of the primer.
Figure 1E:
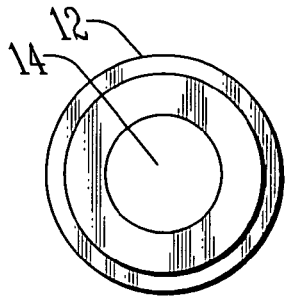
FIG. 1E is a front elevation view of the primer.
Figure 1F:
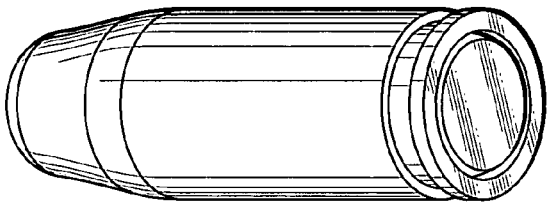
FIG.1F PRIOR ART
FIG. 1F is a view of a bullet typically used in a prior art firearm.

FIGS. 1A-C show the projectile (10) as a typical air gun pellet. Most air guns have a projectile caliber of .177 (4.5 mm) and are designed for target practice. Other caliber typically utilized for air guns include, but are not limited to, .20 (−5.0 mm), .22 (−5.5 mm) and .25 (−6.0 mm). Another projectile commonly used in air guns is the standard BB. The BB is a small metal ball usually made out of copper-coated steel. Because of the spherical shape, the BB is not a particularly accurate projectile and is commonly only used by enthusiasts participating in non-competitive target shooting and non-hunting situations. The projectile (10) may be made of metal, plastic or other materials.

FIGS. 1A-E further disclose a primer cap (12). The primer cap is a device typically used for igniting the powder charge in modem cartridge ammunition. The primer is typically a small, disposable copper or brass cup, 4 to 6 mm in diameter (standard sizes are 0.175 inches and 0.210 inches for handguns, rifle and shotgun cartridges). In the cup of the primer cap is a precise amount of stable, but shock-sensitive explosive compound. When a striker or hammer hits the rear end of the cup, the cup is pierced, which causes the shock-sensitive chemical compound to explode. In an ammunition cartridge, this explosion then ignites the gun powder, which then explodes, causing the projectile attached to the cartage to launch out a gun barrel at a very high rate of speed.

FIGS. 1A-B further depict the preferred orientation of the projectile (10) and primer cap (12) in engagement with one another, which results in the greatest velocity for the projectile (10). The distance between the primer cap (12) and the projectile (10) can be varied because the pellet (10) and cap (12) are not physically connected, which reduces the velocity of the projectile (10). It has been found that spacing between the cap (12) and projectile (10) within the chamber (14) can vary the muzzle speed of the projectile (10) when exiting from the barrel (22) from 800-1800 fps. It is contemplated that the primer cap (12) and the projectile could be connected by a means that would insure correct spacing between the cap (12) and the projectile (10). The means of connecting the cap (12) and projectile (10) might include a plastic connector, a resin, or metallic material that is easily separable from the components.

Figure 2:
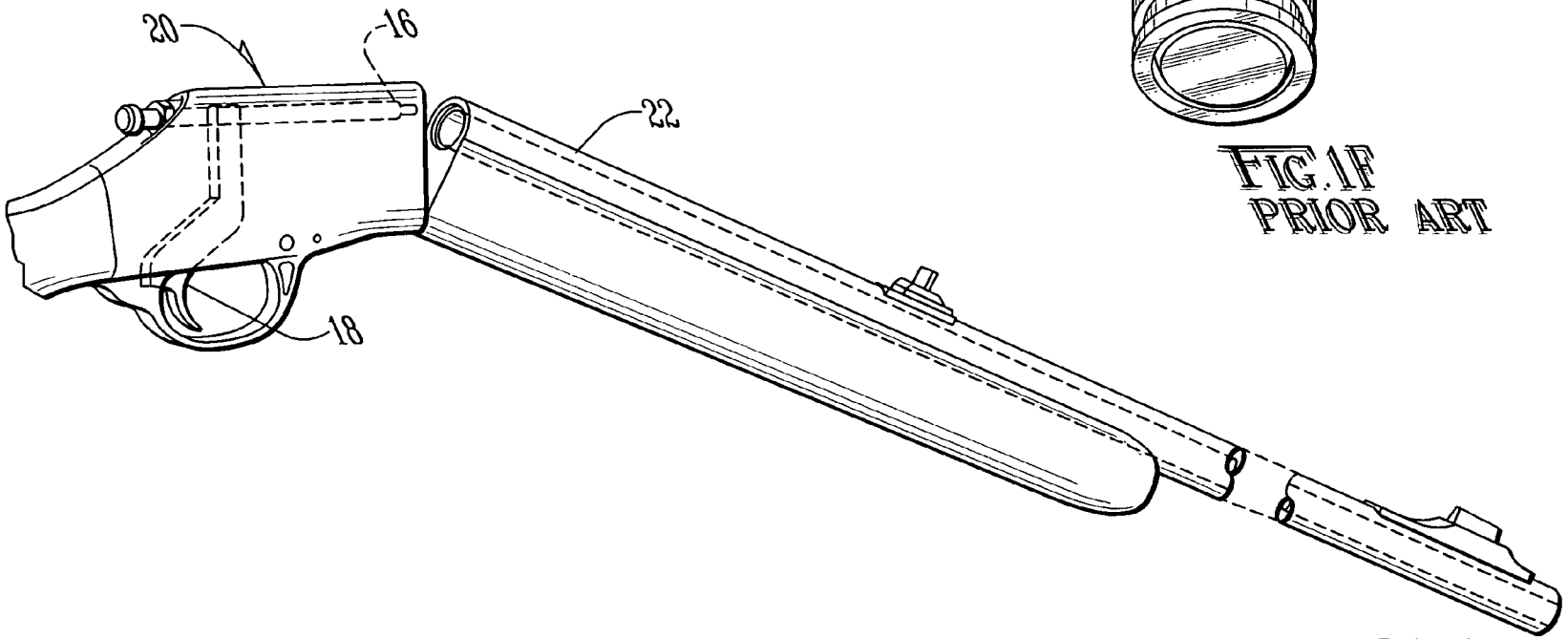
FIG. 2 is a perspective view of the embodiment depicting an air gun in the open position.
Figure 3:
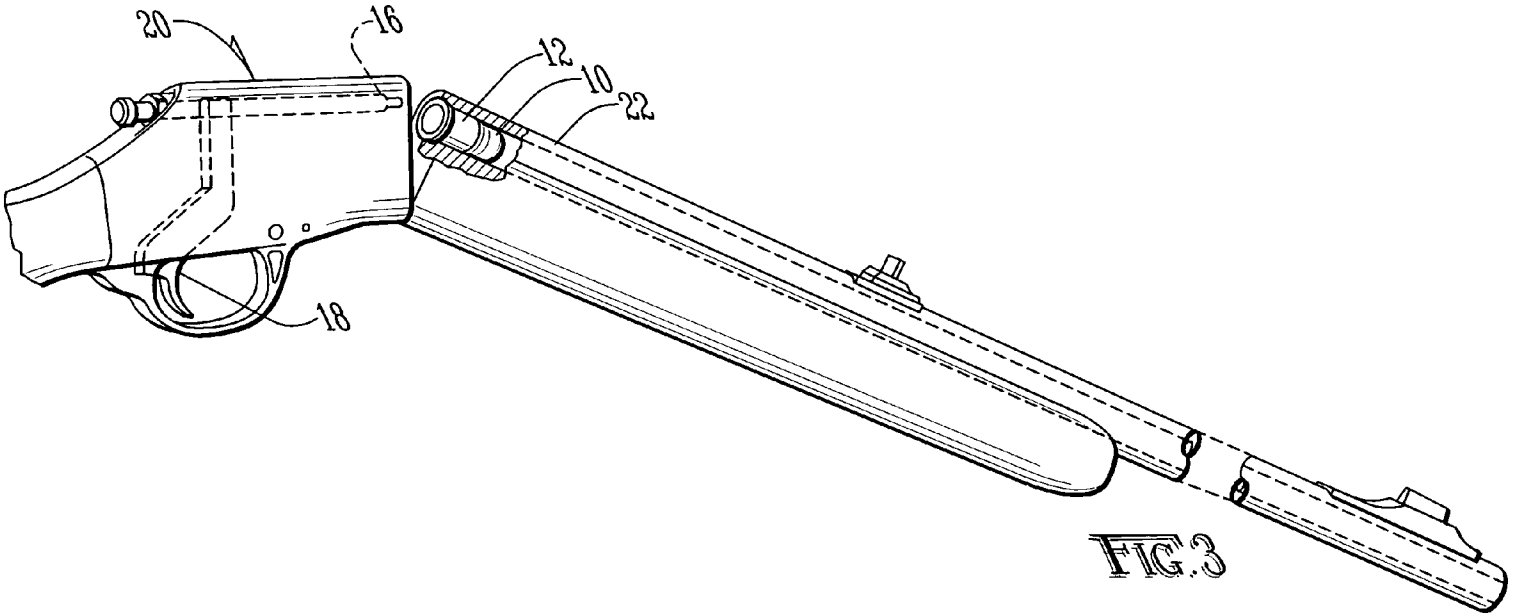
FIG. 3 is a perspective view of the embodiment depicting the air gun in the open position and a primer cap and projectile loaded in the compression chamber.

FIGS. 2 through 5 depict a single method of launching a projectile (10) from an air gun (20) using a primer cap (12). FIG. 2 depicts the air gun (20) with a traditional break barrel open breech loading mechanism. Other mechanisms might include a rear breech, bolt action, revolver, lever actuated or pump actuated loading mechanism. Further, it is contemplated that the combination of projectile (10) and cap (12) could be loaded into the breech of an air gun (20) via a magazine designed to carry multiple combinations to facilitate more rapid reloading.

Figure 4:
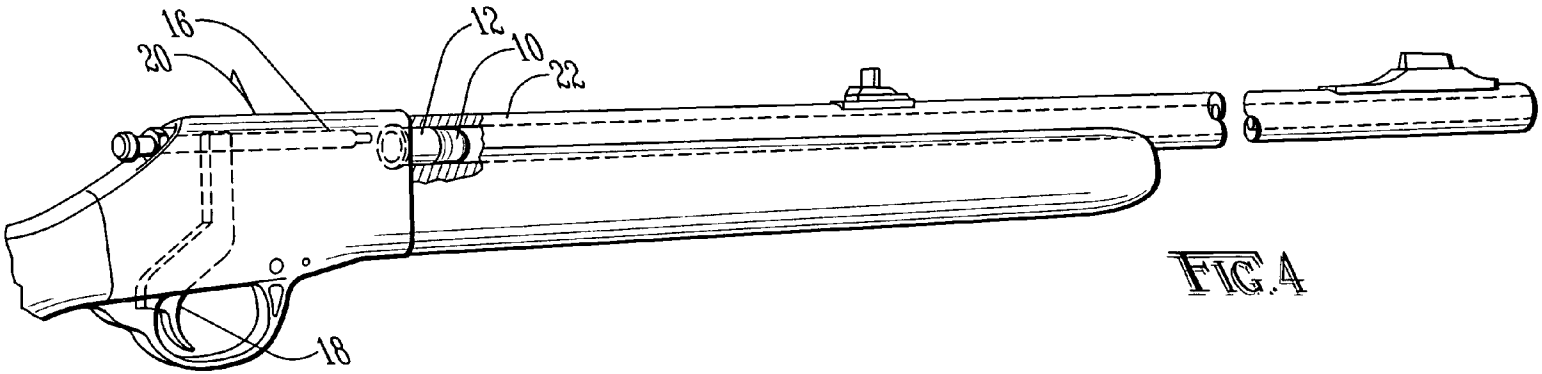
FIG. 4 is a perspective view of the embodiment depicting the air gun in the closed position with a primer cap and projectile loaded in the compression chamber.
Figure 5:
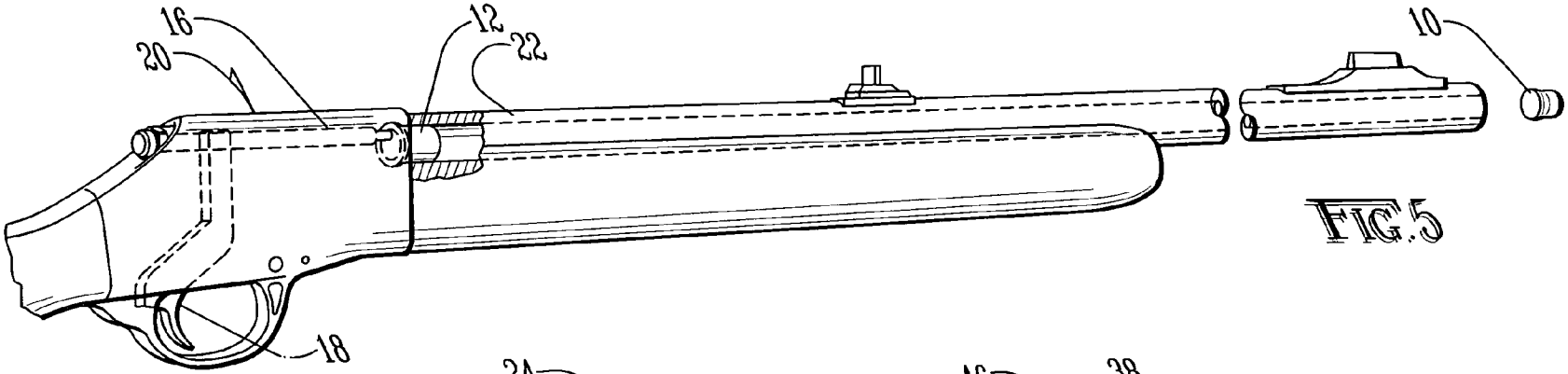
FIG. 5 is a perspective view of the embodiment where the cap has been exploded and the projectile ejected out of the gun barrel.

FIG. 4 depicts the air gun (20) in the loaded position. The loaded position consists of the cap (12) being placed adjacent a firing mechanism (16) and the barrel (22) in-line with the firing mechanism (16), which includes a striker or hammer. When the trigger (18) is squeezed by the shooter, the striker or hammer of the firing mechanism (16) hits or dents the cap (12), causing the shock-sensitive chemical compound to explode. This explosion propels the projectile (10) to rapidly exit from the gun barrel (22) as depicted in FIG. 5.

Figure 6:
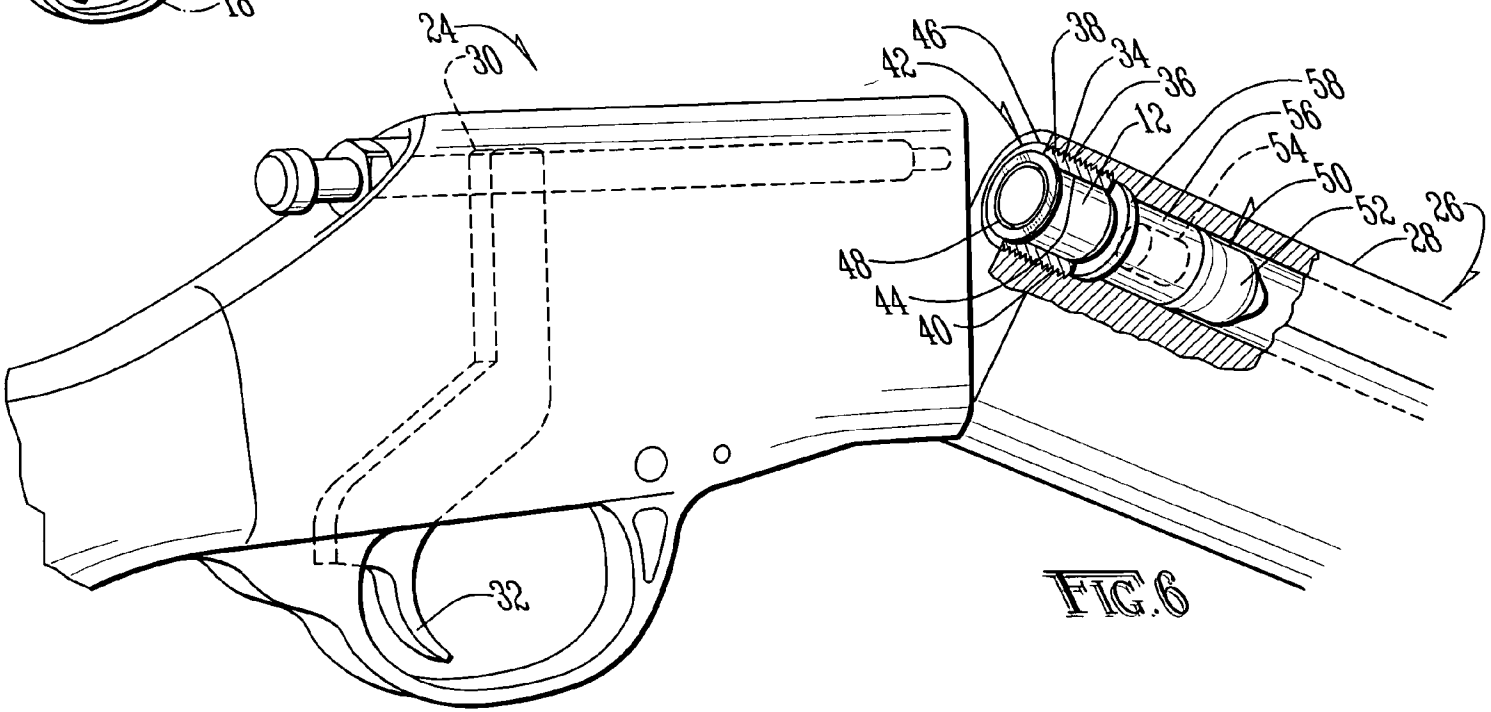
FIG. 6 is a perspective view of an alternative embodiment of the present invention utilizing a sabot.
Figure 7:
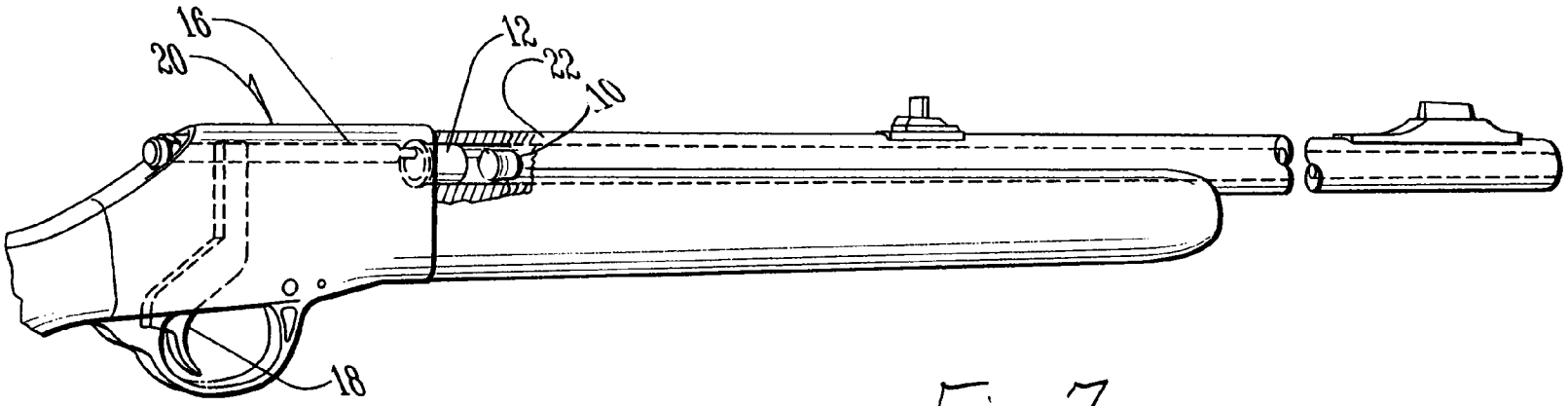
FIG. 7 is a perspective view of an alternative embodiment of the present invention wherein the barrel couples the container to the projectile in a manner that maintains a greater airspace between the projectile and the container.

As shown in FIG. 6, in an alternative embodiment of the present invention a gun (26) is provided with a barrel (28) and a firing mechanism (30), such as that described above. The firing mechanism (30) is operably coupled to a trigger (32). An annular breech plug (34) is provided on its exterior (36) with threads (38) for threadable engagement with threads (40) provided on the breech end (42) of the barrel (28) of the gun (26).

The breech plug (34) is provided with a round opening (44) sized to accommodate the primer cap (12), which in the preferred embodiment, is a non-rimfire, such as a 209 type primer cap, such as that known in the art. The opening (44) provided in the breech plug (34) is preferably sized and configured so as to provide substantially airtight engagement around the primer cap (12), but not so tight as to prevent removal of the primer cap (12) from the breech plug opening (44). The primer cap (12) is provided with a rim (46) to catch on the face (48) of the breech plug (34) to prevent the primer cap (12) from being pushed through the opening (44) in the breech plug (34). The rim (46) can also be used for automatic or manual removal of the primer cap (12) from the breech plug opening (44).

A pellet (50) is provided in the barrel (28). The pellet (50) may be loaded through the muzzle. Alternatively, the pellet (50) may be loaded through the breech end (42) of the barrel (28) before the insertion of the primer cap (12). If desired, the primer cap (12) may instead be coupled to the portion of the gun (26) having the firing mechanism (30) so that the pellet (50) may be loaded into the barrel (28) through the breech end (42) of the barrel (28) before the gun (26) is closed.

As shown in FIG. 6, the pellet (50) comprises an enlarged head (52) coupled to a narrow body (54) and surrounded by a spacer. In the preferred embodiment, the spacer is a sabot (56). The sabot (56) is constructed of plastic and provided around the narrow body (54) of the pellet (50). The sabot (56) may be constructed of metal, plastic, resin or any other suitable material known in the art. While the sabot (56) and pellet (50) jointly comprise the projectile, the sabot (56) may be designed to release from the pellet (50) after the pellet (50) leaves the barrel (28).

The sabot (56) provides an airtight seal and prevents damage to the body (54) of the pellet (50). The sabot (56) is provided in contact with the primer cap (12) to achieve pellet speeds preferably in excess of 500 feet per second and, more preferably, in excess of 1,000 feet per second, and most preferably in excess of 1,250 feet per second. Alternatively, the pellet (50) may be spaced apart from the primer cap (12) to change the speed of the pellet (50).

If desired, the barrel (28) may be provided with ridges to engage the sabot (56) at various distances from the primer cap (12) to create any desired airspace between the primer cap (12) and pellet (50) to change the speed of the pellet (50) existing from the barrel (28). As shown in FIG. 6, the sabot (56) is preferably provided with a rim (58) in airtight engagement with the barrel (28) to prevent gases escaping from the primer cap (12) around the pellet (50).

A general description of the present invention as well as the preferred embodiment to the present invention has been set forth. Those skilled in the art to which the present invention pertains will recognize and be able to practice additional variations in the method and systems described which fall within the teaching of this invention. Accordingly, all such modifications and additions are deemed to be within the scope of the invention which can be limited only by the claims appended hereto.

What is claimed is:

1. A gun comprising:

(a) a monolith barrel having a muzzle;

(b) a projectile no greater than .22 caliber, wherein the projectile is frictionally engaged directly to said barrel;

(c) wherein the muzzle is located at the end of the gun;

(d) a shock sensitive explosive;

(e) a non-rimfire container provided within said barrel and provided around said shock sensitive explosive, said container defining a cavity;

(f) wherein no portion of the projectile is located within the container;

(g) wherein no propellant is positioned between said projectile and said shock sensitive explosive;

(h) a firing mechanism configured to detonate said shock sensitive explosive; and (i) a trigger coupled to said firing mechanism.

2. The gun of claim 1, further comprising a spacer provided between said shock sensitive explosive and said projectile.

3. The gun of claim 1, further comprising a sabot provided in contact with said projectile.

4. A gun comprising:

(a) a monolith barrel having a muzzle;

(b) a projectile no greater than .22 caliber, wherein the projectile is frictionally engaged directly to said barrel;

(c) wherein the muzzle is located at the end of the gun;

(d) a shock sensitive explosive;

(e) a non-rimfire container provided around said shock sensitive explosive;

(f) wherein no propellant is positioned between said projectile and said shock sensitive explosive;

(g) wherein no portion of the projectile is located within the container;

(h) a firing mechanism configured to detonate said shock sensitive explosive; and (i) a trigger coupled to said firing mechanism.

5. The gun of claim 4, further comprising a spacer provided between said shock sensitive explosive and said projectile.

6. The gun of claim 5, wherein said spacer is a sabot.

7. A method for propelling a projectile from a gun comprising:

(a) providing a gun comprising;

(i) a monolith barrel having a muzzle;

(ii) wherein the muzzle is located at the end of the gun;

(iii) a trigger; and (iv) a firing mechanism coupled to said trigger;

(b) providing a projectile no greater than .22 caliber;

(c) providing a non-rimfire container within said barrel;

(d) providing a shock sensitive explosive at least partially within said container;

(e) securing the projectile in a manner in which no portion of the projectile is located within the container;

(f) wherein no propellant is positioned between said projectile and said shock sensitive explosive;

(g) providing said container rearward of said projectile;

(h) actuating said trigger in a manner which causes said firing mechanism to detonate said shock sensitive explosive; and (i) directing a sufficient amount of an expanding gas from said container toward said projectile to propel said projectile out of said barrel.

8. The method for propelling a projectile from a gun of claim 7, further comprising providing said projectile a predetermined distance from said container.

9. The method for propelling a projectile from a gun of claim 7, further comprising providing a spacer between said shock sensitive explosive and said projectile.

* * * * *